US006983738B2

(12) United States Patent
Nakamura

(10) Patent No.: US 6,983,738 B2
(45) Date of Patent: Jan. 10, 2006

(54) ENGINE CONTROL SYSTEM

(75) Inventor: Michihisa Nakamura, Shizuoka (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 10/493,290

(22) PCT Filed: Oct. 22, 2002

(86) PCT No.: PCT/JP02/10945

§ 371 (c)(1),
(2), (4) Date: Apr. 22, 2004

(87) PCT Pub. No.: WO03/038261

PCT Pub. Date: May 8, 2003

(65) Prior Publication Data

US 2004/0244773 A1 Dec. 9, 2004

(30) Foreign Application Priority Data

Oct. 29, 2001 (JP) ..... 2001-331529
Oct. 31, 2001 (JP) ..... 2001-335479

(51) Int. Cl.
*F02D 41/00* (2006.01)
*F02D 41/10* (2006.01)

(52) U.S. Cl. ..... 123/492; 123/494

(58) Field of Classification Search ..... 123/478, 123/480, 492, 494; 701/110; 73/118.2
See application file for complete search history.

(56) References Cited

U.S. PATENT DOCUMENTS

| | | | | |
|---|---|---|---|---|
| 4,658,787 A | | 4/1987 | Takizawa | |
| 5,211,150 A | * | 5/1993 | Anzai | 123/480 |
| 5,635,634 A | | 6/1997 | Reuschenbach et al. | |
| 6,109,244 A | * | 8/2000 | Yamamoto et al. | 123/494 |
| 6,131,554 A | * | 10/2000 | Ito et al. | 123/568.14 |
| 6,202,626 B1 | * | 3/2001 | Ito et al. | 123/336 |

FOREIGN PATENT DOCUMENTS

| | | | |
|---|---|---|---|
| JP | 60-60223 | * | 4/1985 |
| JP | 10-184438 | | 7/1998 |
| JP | 10-227252 | | 8/1998 |
| JP | 11-036969 | | 2/1999 |
| JP | 2002-188536 | | 7/2002 |

* cited by examiner

*Primary Examiner*—Tony M. Argenbright
(74) *Attorney, Agent, or Firm*—Hogan & Hartson, LLP

(57) ABSTRACT

In an engine control system, an accelerating condition is detected from the phase of a crankshaft and an induction air pressure. A stroke condition is detected from a rotational angle of the crankshaft and an induction air pressure. A differential pressure between induction pipe pressures detected at a predetermined crank angle on an exhaust stroke and an induction stroke and induction pipe pressures resulting at the same crank angle on the same strokes is calculated as an induction air pressure difference $\Delta P_{A\text{-}MAN}$. When $\Delta P_{A\text{-}MAN}$ is equal to or larger than the threshold, an accelerating condition is determined to be occurring, and fuel in acceleration is immediately added to a steady-state fuel injection amount for injection. To improve accelerating condition and the induction air amount detection accuracy, a volume from a throttle valve to an induction port is made equal to or smaller than the volume of the stroke of a cylinder.

1 Claim, 11 Drawing Sheets

ENGINE CONTROL SYSTEM

TECHNICAL FIELD

The present invention relates to an engine control system controlling an engine, particularly an engine having fuel injection devices.

BACKGROUND ART

In recent years, with the spread of fuel injection devices called injectors, the control of timing of injecting fuel and amount of fuel that is injected or air-fuel ratio has been getting easier, and as a result, it becomes possible to promote the realization of higher outputs, lower fuel consumption and cleaner exhaust emissions. Of these controlled items, in particular, as to the fuel injection timing, it is general practice to detect, strictly speaking, the condition of an inlet valve or, generally speaking, the phase condition of a camshaft and then to inject fuel to the result of the detection. However, a so-called camshaft sensor for detecting the phase condition of the camshaft is expensive and results in enlargement of a cylinder head when attempted to be fitted on, in particular, motorcycles, and as a result of these problems, the camshaft sensor cannot be adopted on motorcycles. Due to this, JP-A-10-227252, for example, proposes an engine control system for detecting the phase condition of a crankshaft and the pressure of induction air and then detecting the stroke condition in a cylinder from the results of the detections. Consequently, since the stroke condition can be detected without detecting the phase of the camshaft by using the conventional technique, it becomes possible to control the timing of injecting fuel to the stroke condition so detected.

Incidentally, in order to control the injection amount of fuel injected from the aforesaid fuel injection device, a target air-fuel ratio is set in accordance with, for example, engine rotational speed and throttle opening, an actual amount of induction air is detected, and the detected induction air amount is multiplied by the reciprocal ratio of the target air-fuel ratio, whereby a target fuel injection amount can be calculated.

While, in detecting the induction air amount, hot-wire airflow sensors and Karman vortex sensors are generally used as sensors for measuring mass flow and volume flow rate, respectively, a volume unit (a surge tank) for suppressing pressure pulsation is needed to eliminate a main factor for errors resulting from a reverse airflow, or the sensors need to be mounted on positions which are free from the entry of reverse airflow. However, in many engines for motorcycles, an intake system to each cylinder is a so-called independent intake system, or an engine itself is a single-cylinder engine, and in many cases the required conditions cannot be satisfied, and the induction air amount cannot be detected accurately even with these flow rate sensors.

In addition, an induction air amount is detected toward the end of an induction stroke or the beginning of a compression stroke, and since fuel has already been injected then, the control of air-fuel ratio using this induction air amount can only be implemented on the following cycle. This causes a rider to feel a feeling of physical disorder of not obtaining a sufficient acceleration because a torque and output that meet an acceleration which the rider has attempted to obtain by opening the throttle cannot be obtained until the following cycle even if the rider attempts to due to the control of air-fuel ratio being implemented based on the previous target air-fuel ratio. With a view to solving the problem, the intention of the rider to accelerate may be detected using a throttle valve sensor or a throttle position sensor for detecting the condition of the throttle, but, in the case of motorcycles, in particular, these sensors cannot be adopted since they are large in size and expensive, and therefore, the problem has not yet been solved currently.

The invention was developed to solve the problems and provides an engine control system which can obtain a sufficient acceleration by controlling the air-fuel ratio by detecting the intention of the rider to accelerate without using a throttle valve sensor or a throttle position sensor.

DISCLOSURE OF THE INVENTION

With a view to solving the problems, according to the invention, there is provided an engine control system characterized by provision of a phase detection means for detecting a phase of a crankshaft of a four-cycle engine, an induction air pressure detection means for detecting an induction air pressure on a downstream side of a throttle valve within an induction passageway of the engine, and an engine control means for detecting a load of the engine based on the phase of the crankshaft detected by the phase detection means and the induction air pressure detected by the induction air pressure detection means and controlling operating conditions of the engine based on the load of the engine so detected, wherein a volume from the throttle valve to an induction port of the engine is made equal to or smaller than the volume of the stroke of a cylinder.

BEST MODE FOR CARRYING OUT THE INVENTION

An embodiment of the invention will be described below.

Figure 1:
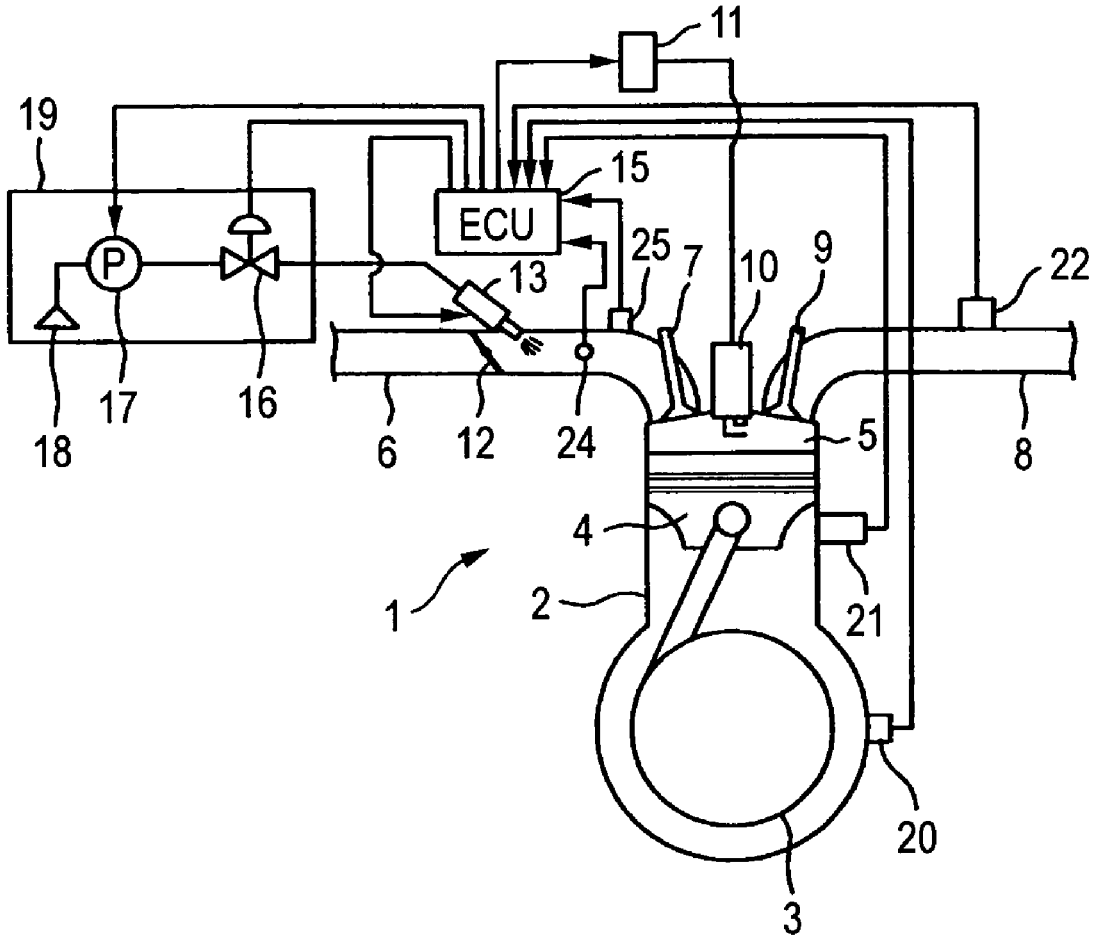
FIG. 1 is a schematic diagram illustrating the construction of a motorcycle engine and a control system therefor.

FIG. 1 is a schematic diagram illustrating the construction of a motor cycle engine and a control system therefor. This engine 1 is a single-cylinder four-cycle engine of a relatively small displacement and comprises a cylinder body 2, a crankshaft 3, a piston 4, a combustion chamber 5, an induction pipe 6, a inlet valve 7, an exhaust pipe 8, an exhaust valve 9, a spark plug 10, and an ignition coil 11. In addition, a throttle valve 12 adapted to be opened and closed in accordance with the opening of an accelerator is provided within the induction pipe 6, and an injector 13 as a fuel injection device is provided on a downstream side of the throttle valve 12 in the induction pipe (an induction passageway) 6. The injector 13 is connected to a filter 18, a fuel pump 17 and a pressure control valve 16 which are disposed within a fuel tank 19.

The operating condition of this engine 1 is controlled by an engine control unit 15. Then, provided as means for inputting control inputs into the engine control unit 15 or detecting the operating condition of the engine 1 are a crank angle sensor 20 for detecting the rotational angle or phase of the crankshaft 3, a coolant temperature sensor 21 for detecting the temperature of the cylinder body 2 or a coolant, namely, the temperature of an engine main body, an exhaust air-fuel ratio sensor 22 for detecting an air-fuel ratio within the exhaust pipe 8, an induction air pressure sensor 24 for detecting an induction air pressure within the induction pipe 6 and an induction air temperature sensor 25 for detecting a temperature within the induction pipe 6 or the temperature of induction air. Then, the engine control unit 15 receives detection signals from these sensors as inputs and outputs control signals to the fuel pump 17, the pressure control valve 16, the injector 13 and the ignition coil 11.

Figure 2A:
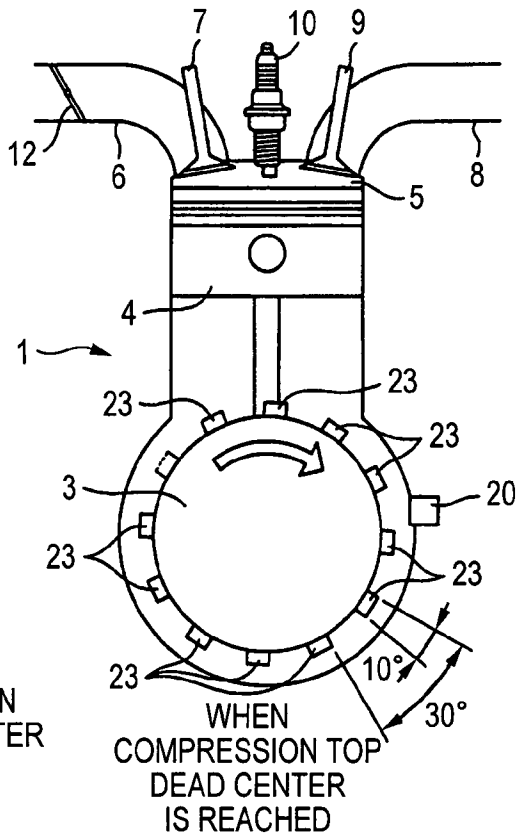
FIGS. 2*a* and 2*b* are explanatory diagram diagrams of a principle based on which a crank pulse is sent out on the engine in FIG. 1.

Here, a principle of a crank angle signal outputted from the crank angle sensor 20 will be described. In this embodiment, as shown in FIG. 2*a*, a plurality of teeth 23 are provided on an outer circumference of the crankshaft 3 at substantially equal intervals in such a manner as to protrude therefrom, so that an approach of the teeth is detected by a magnetic sensor such as the crank angle sensor 20 and is then subjected to an appropriate electric process, whereafter a pulse signal is sent out. A circumferential pitch between the respective teeth 23 is set to 30 degrees when represented by the phase (rotational angle) of the crankshaft 3, and a circumferential width of each tooth 23 is set to 10 degrees when represented by the phase (rotational angle) of the crankshaft 3. However, the pitch is not applied to only one location where the pitch is made to be double the pitch of the other teeth 23. As shown in a double-dashed line in FIG. 2*a*, there is provided a special setting that no tooth is provided at a position where a tooth should have been provided according to the original construction, and this portion corresponds to an irregular interval. Hereinafter, this portion is also referred to as a tooth-missing portion.

Figure 2B:
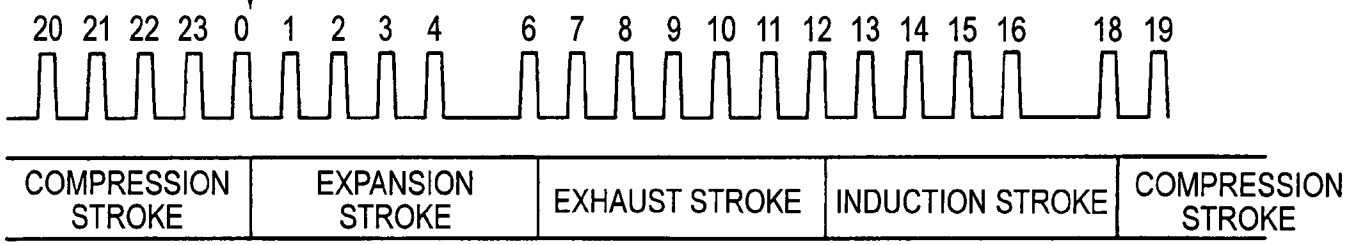

Consequently, a pulse signal train of each tooth 23 when the crankshaft 3 rotates at constant speeds is represented as shown in FIG. 2*b*. Then, while FIG. 2*a* illustrates a condition where a top dead center on a compression stroke is reached (a top dead center on an exhaust stroke is identical in form to this), pulse signals are numbered up to "4" in such a manner that a pulse signal immediately before the top dead center on the compression stroke is reached is illustrated as "0", the following pulse is illustrated as "1", a pulse following this is illustrated as "2" and the like. Since next to the tooth 23 corresponding to the pulse signal illustrated as "4" is the tooth-missing portion, it is considered as if there existed a tooth at the tooth-missing portion and an excess tooth is then counted, so that a tooth 23 following the tooth-missing portion is illustrated as "6". As this procedure is repeated, since a tooth-missing portion approaches following a pulse signal illustrated as "16", in a similar manner to the previously described one, an excess tooth is counted so that a pulse signal following the tooth-missing portion is numbered, as illustrated, as "18". When the crankshaft 3 turns two revolutions, since a cycle of four strokes is completed, after the numbering is finished with, as illustrated, "23", another numbering is started with "0" as illustrated. In principle, the top dead center on the compression stroke is reached immediately after a pulse signal of the tooth 23 which is numbered as "0" as illustrated. Thus, the pulse signal train so detected or the single pulse signal of the train is defined as a crank pulse. Then, in the event that a stroke detection is performed based on this crank pulse signal as will be described later on, a crank timing can be detected. Note that the same effect can be attained even if the teeth 23 are provided on the outer circumference of a member which rotates in synchronism with the crankshaft 3.

Figure 3:
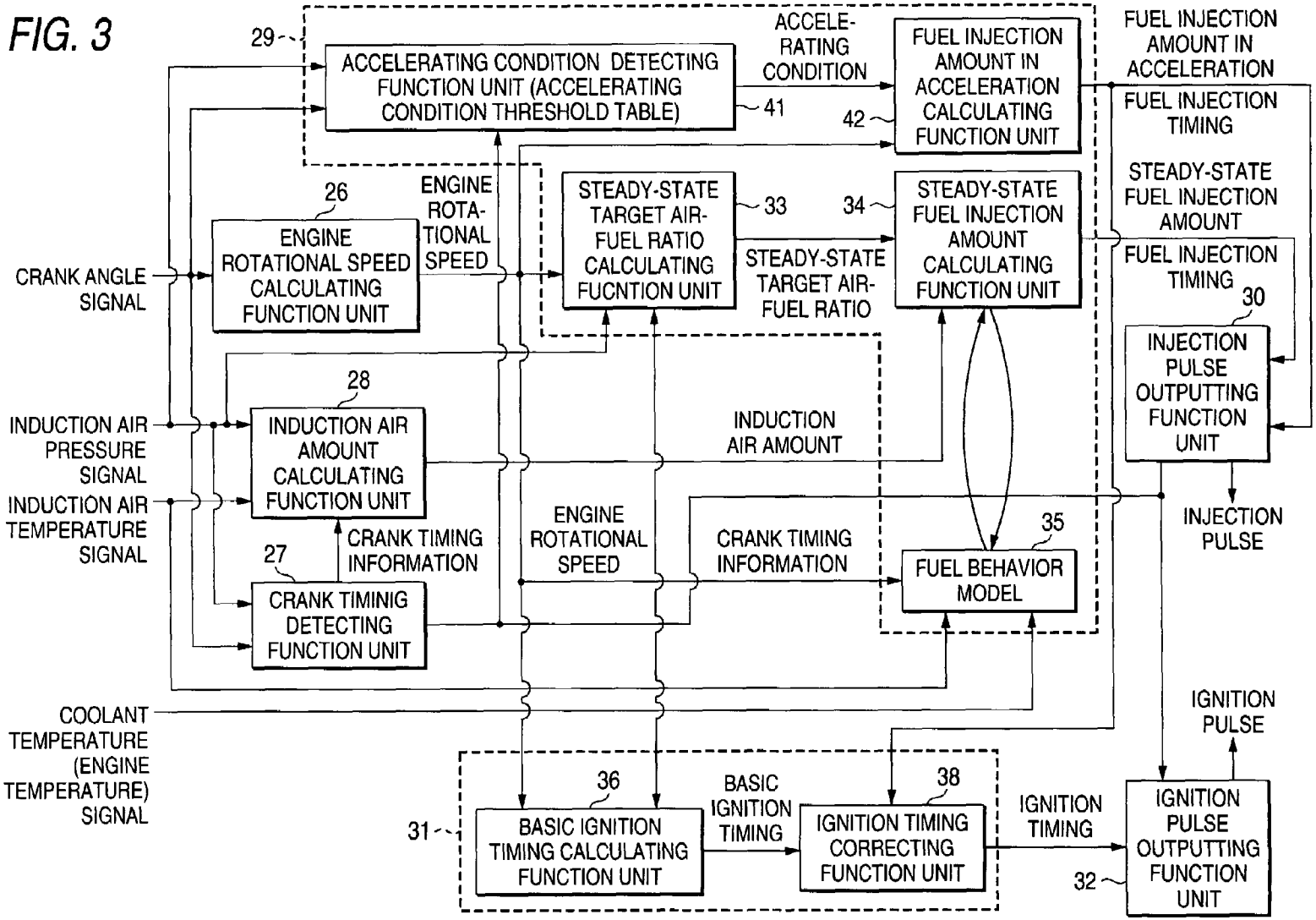
FIG. 3 is a block diagram illustrating an embodiment of an engine control system of the invention.

On the other hand, the engine control unit 15 includes a microcomputer which is not shown. FIG. 3 is a block diagram illustrating a mode of an engine control operation process which is implemented by the microcomputer within the engine control unit 15. This operation process is configured to be completed by an engine rotational speed calculating function unit 26 for calculating an engine rotational speed from the crank angle signal, a crank timing detecting function unit 27 for detecting crank timing information or a stroke condition from the same crank angle signal and the induction air pressure signal, an induction air amount calculating function unit 28 for reading in the crank timing information detected at the crank timing detecting function unit 27 and then calculating an induction air amount from the induction air temperature signal and the induction air pressure signal, a fuel injection amount setting function unit 29 for calculating and setting a fuel injection amount and a fuel injection timing by setting a target air-fuel ratio based on the engine rotational speed calculated at the engine rotational speed calculating function unit 26 and the induction air amount calculated at the induction air amount calculating function unit 28 and detecting an accelerating condition, an injection pulse outputting function unit 30 for reading in the crank timing information detected at the crank timing detecting function unit 27 and outputting an injection pulse according to the fuel injection amount and the fuel injection timing which are set at the fuel injection amount setting function unit 29 to injector 13, an ignition timing setting function unit 31 for reading in the crank timing information detected at the crank timing detecting function unit 27 and setting an ignition timing based on the engine rotational speed calculated at the engine rotational speed calculating function unit 26 and the fuel injection amount calculated at the furl injection amount setting function unit 29 and an ignition pulse outputting function unit 32 for reading in the crank timing information detected at the crank timing detecting function unit 27 and outputting an ignition pulse according to the ignition timing set at the ignition timing setting function unit 31 to the ignition coil 11.

The engine rotational speed calculating function unit 26 calculate a rotational speed of the crankshaft which is an output shaft of the engine as an engine rotational speed from a time variation rate of the crank angle signal. To be specific, an instantaneous value of the engine rotational speed which results by dividing a phase between the adjacent teeth 23 by a time spent detecting a corresponding crank pulse and an average value of the engine rotational speed which is constituted by a moving average value thereof.

Figure 4:
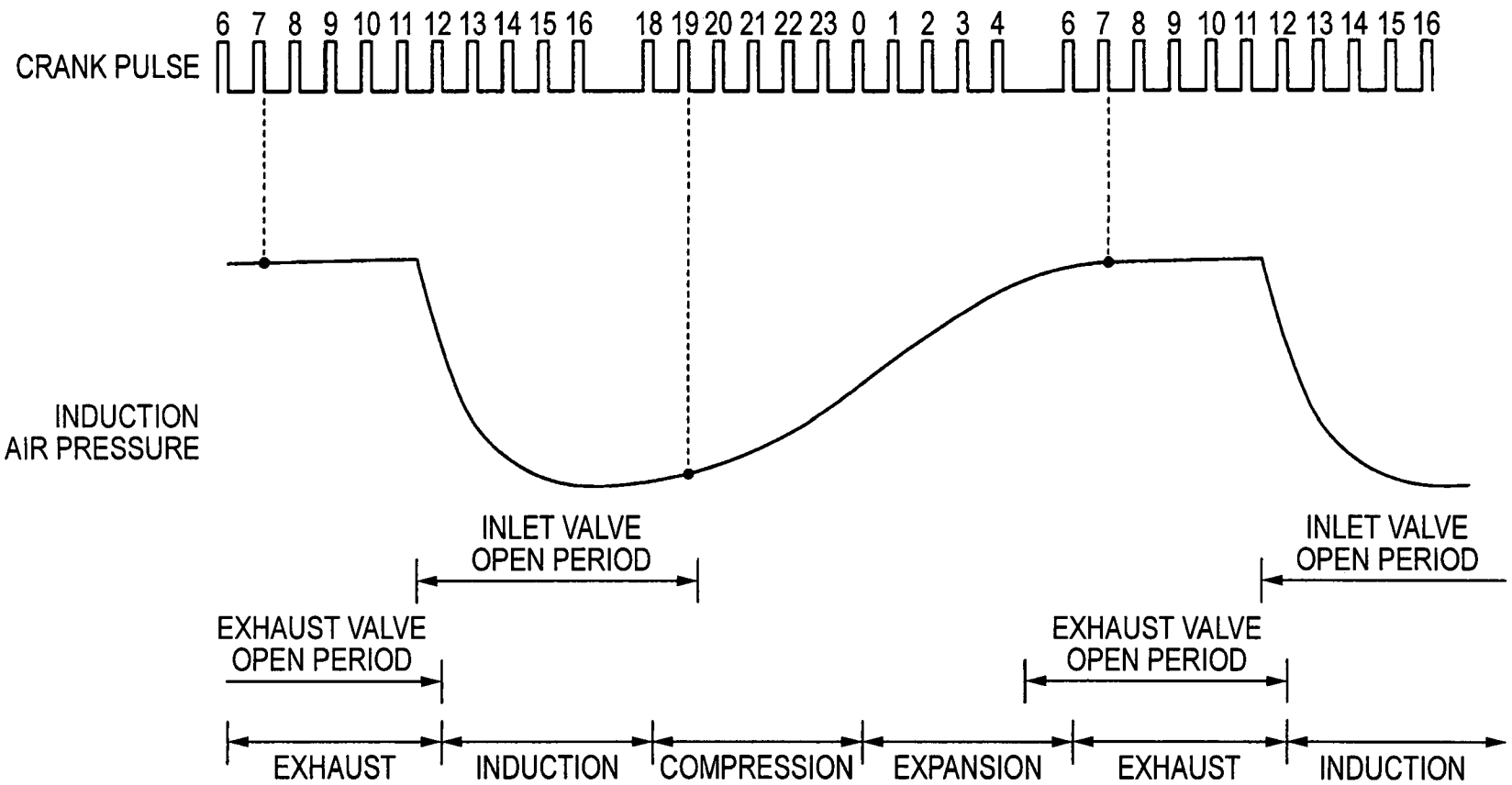
FIG. 4 is an explanatory diagram explaining a detection of a stroke condition from the phase of a crankshaft and an induction air pressure.

The crank timing detecting function unit 27 has a similar configuration to that of a stroke identifying device described the aforesaid JP-A-10-227252, detects a stroke condition in each cylinder as shown in FIG. 4, for example, from that configuration for output and outputs the detected stroke condition as crank timing information. Namely, in a four-cycle engine, since a crankshaft and a camshaft continue to rotate at all times with a predetermined phase difference, when a crank pulse is read as shown in FIG. 4, for example, a crank pulse as illustrated as "9" or "21" which is located at a fourth place from the tooth-missing portion represents either an exhaust stroke or a compression stroke. As is known, since the exhaust valve is closed and the inlet valve is closed on the exhaust stroke, the induction air pressure is high, and since the inlet valve is still opened at the beginning of the compression stroke, the induction air pressure is low, or even if the inlet valve is closed, the induction air pressure is low in the wake of the proceeding induction stroke. Consequently, the crank pulse illustrated as "21" when the induction air pressure is low represents that the compression stroke is being performed, and the top dead center is reached immediately after the crank pulse illustrated as "0" is obtained. Thus, after either of the stroke conditions has been able to be detected; in the event that a duration of the stroke is interpolated by the rotational speed of the crankshaft, the current stroke condition can be detected in greater detail.

Figure 5:
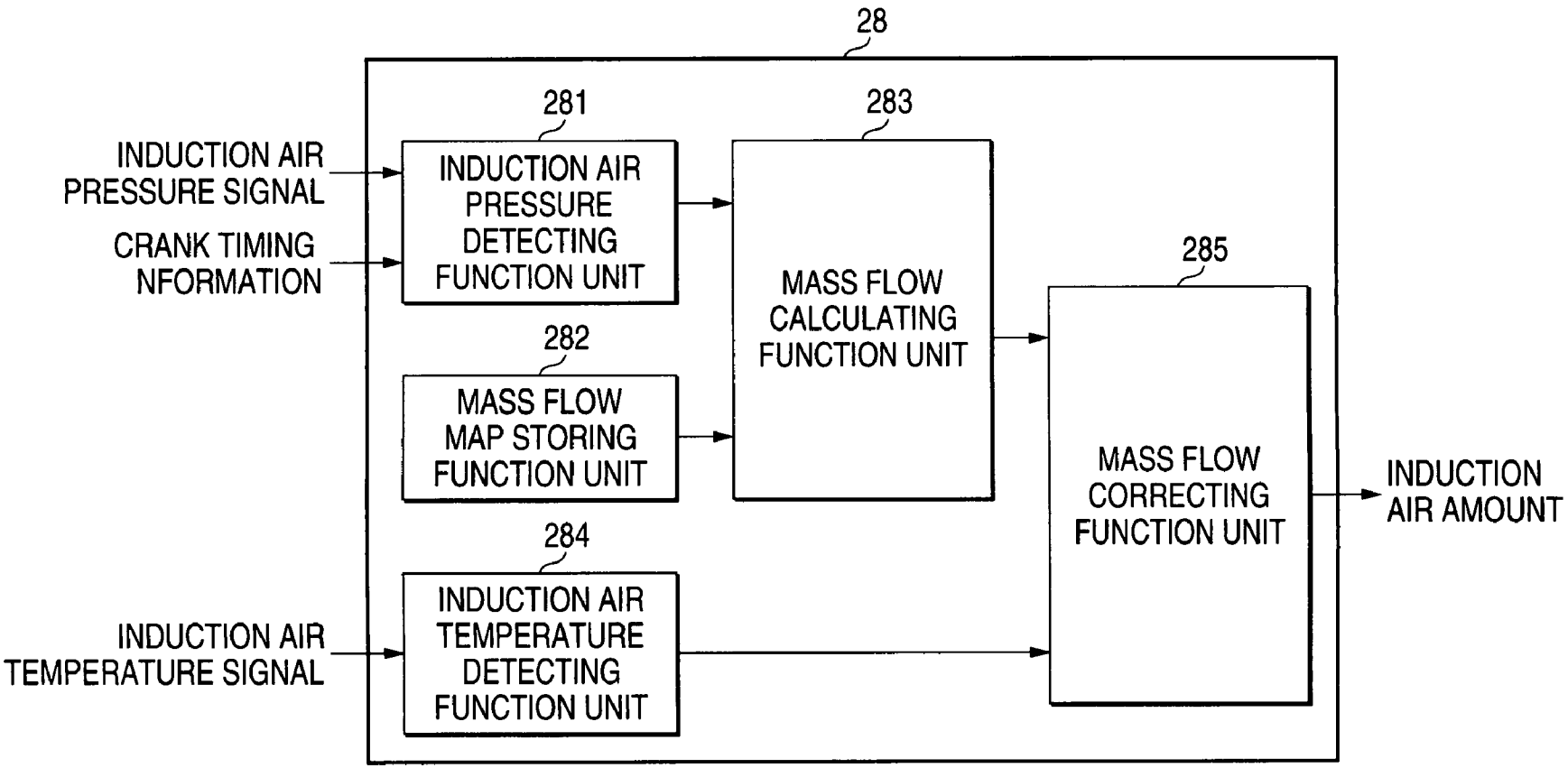
FIG. 5 is a block diagram of an induction air amount calculating function unit.

As shown in FIG. 5, the induction air amount calculating function unit 28 includes an induction air pressure detecting function unit 281 for detecting an induction air pressure from the induction air pressure signal and the crank timing information, a mass flow map storing function unit 282 which stores a map for detecting the mass flow of induction air from an induction air pressure, a mass flow calculating function unit 283 for calculating a mass flow according to the induction air pressure detected using the mass flow map, an induction air temperature detecting function unit 284 for detecting an induction air temperature from the induction air temperature signal, and a mass flow correcting function unit 285 for correcting the mass flow of the induction air from the mass flow of the induction air calculated at the mass flow calculating function unit 283 and the induction air temperature detected at the induction air temperature detecting function unit 284. Namely, since the map is prepared based on the mass flow when the induction air temperature is 20° C., for example, an induction air amount is calculated by correcting the map by an actual induction air temperature (an absolute temperature ratio).

In this embodiment, an induction air amount is calculated using an induction air pressure value resulting from a bottom dead center on the compression stroke to the inlet valve closing timing. Namely, since the induction air pressure is substantially equal to the cylinder internal pressure when the inlet valve is opened, a cylinder internal air mass can be obtained in the event that the induction air pressure, the cylinder internal volume and the induction air temperature are known. However, since the inlet valve remains opened for some time even after the compression stroke has been initiated, there occur ingress and egress of air between the interior of the cylinder and the induction pipe while the inlet valve remains opened, and therefore, there exists a possibility that the induction air amount obtained from the induction air pressure before the bottom dead center differs from the amount of air which has actually been induced into the cylinder. Due to this, the induction air amount is calculated using the induction air pressure on the compression stroke where there occurs no ingress and egress of air between the interior of the cylinder and the induction pipe even if the inlet valve remains opened. In addition, to be stricter, in consideration of an effect imposed by the partial pressure of burnt gases, a correction may be made according to an engine rotational speed obtained from an experiment using an engine rotational speed which is highly correlative thereto.

Figure 6:
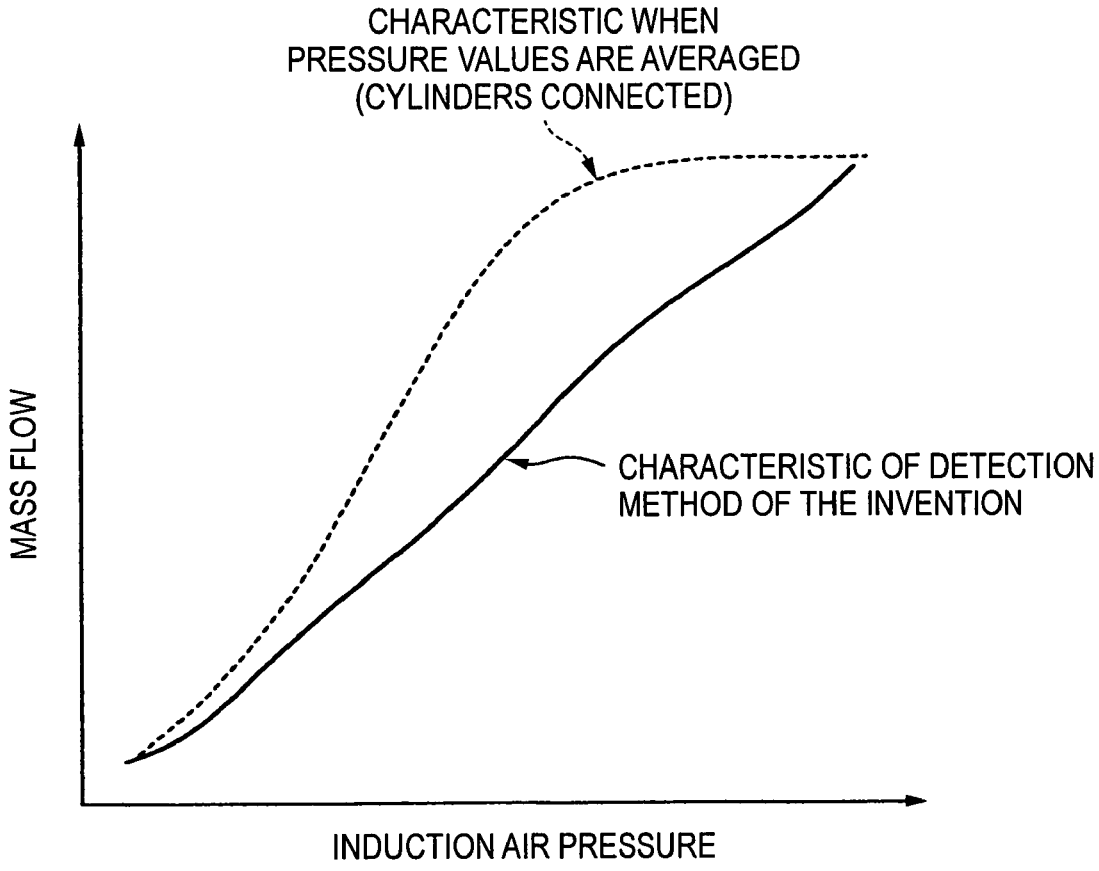
FIG. 6 is a control map for obtaining a mass flow of induction air from an induction air pressure.

Additionally, in the embodiment which adopts the independent air induction system, a mass flow map which has a relatively linear relationship with the induction air pressure, as shown in FIG. 6, is used as a mass flow map for calculating an induction air amount. This is because an air mass to be obtained is based on the Boyle-Charles law (PV=nRT). In contrast to this, in a case where an induction pipe is connected to every cylinder, since a premise that induction air pressure ≈ cylinder internal pressure is not established due to the effect of pressures in the other cylinders, a map illustrated by a broken line in the diagram has to be used.

As shown in FIG. 3, the fuel injection amount setting function unit 29 includes a steady-state target air-fuel ratio calculating function unit 33 for calculating a steady-state target air-fuel ratio based on the engine rotational speed calculated at the engine rotational speed calculating function unit 26 and the induction air pressure signal, a steady-state fuel injection amount calculating function unit 34 for calculating a steady-state fuel injection amount and a fuel injection timing based on the steady-state target air-fuel ratio calculated at the steady-state target air-fuel ratio calculating function unit 33 and the induction air amount calculated at the induction air amount calculating function unit 28, a fuel behavior model 35 which is used to calculate a steady-state fuel injection amount and a steady-state fuel injection timing at the steady-state fuel injection amount calculating function unit 34, an accelerating condition detecting means 41 for detecting an accelerating condition based on the crank angle signal, the induction air pressure signal and the crank timing information detected at the crank timing detecting function unit 37, and a fuel injection amount in acceleration calculating function unit 42 for calculating in accordance with the accelerating condition detected by the accelerating condition detecting function unit 41 a fuel injection amount in acceleration and a fuel injection timing according to the engine rotational speed calculated at the engine rotational speed calculating function unit 26. The fuel behavior model 35 is such as to be substantially integral with the steady-state fuel injection amount calculating function unit 34. Namely, without the fuel behavior model 35, in this embodiment where an injection is implemented into the induction pipe, neither a fuel injection amount nor a fuel injection timing can be calculated and set accurately. Note that the fuel behavior model 35 needs the induction air temperature signal, the engine rotational speed and the coolant temperature signal.

Figure 7:
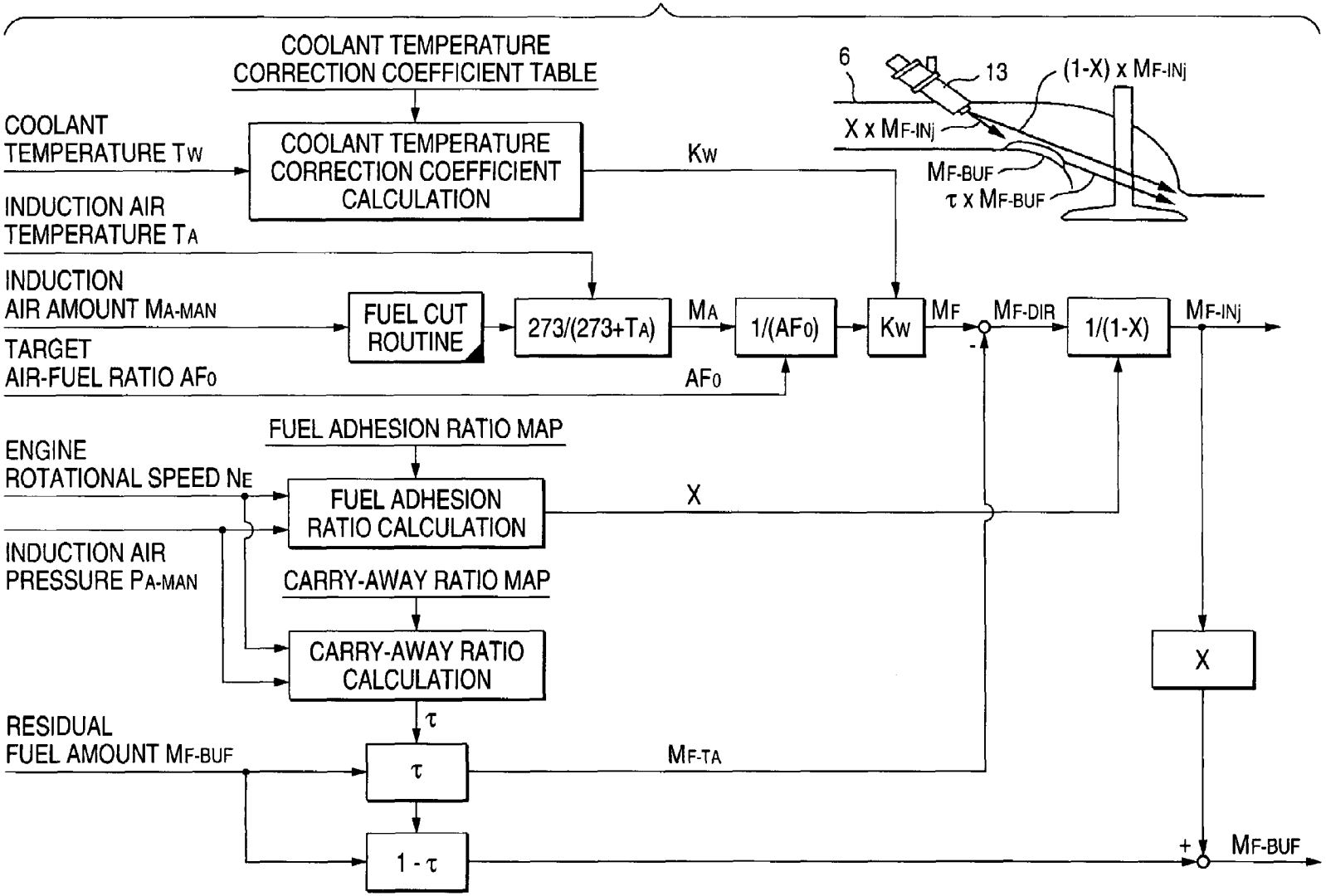
FIG. 7 is a block diagram illustrating a fuel injection amount calculating function unit and a fuel behavior model.

The steady-state fuel injection amount calculating function unit 34 and the fuel behavior model 35 are configured as illustrated in a block diagram shown in FIG. 7, for example. Here, assuming that a fuel injection amount that is the amount of fuel injected from the injector 13 into the induction pipe 6 is $M_{F\text{-}INJ}$ and a fuel adhesion ratio representing a ratio of part of the injected fuel which adheres to a wall of the injection pipe 6 is X, the amount of fuel of the fuel injection amount $M_{F\text{-}INJ}$ that is directly injected into the induction pipe 6 is $((1-X)\times M_{F\text{-}INJ})$ and the adhesion amount of the fuel that adheres to the induction pipe wall is ($X \times M_{F\text{-}INJ}$). Some of the adhering fuel flows into the cylinder along the induction pipe wall. Assuming that the amount of the residual fuel is expressed as a residual fuel amount $M_{F\text{-}BUF}$ and a carry-away ratio which is a ratio of fuel of the residual fuel amount $M_{F\text{-}BUF}$ that is carried away by an induction air flow is $\tau$, the amount of fuel which is so carried away to thereby be allowed to flow into the cylinder is ($\tau \times M_{F\text{-}BUF}$).

Then, at the steady-state fuel injection amount calculating function unit 34, firstly, a coolant temperature correction coefficient $K_w$ is calculated from the coolant temperature $T_w$ using a coolant temperature correction coefficient table. On the other hand, a fuel cut routine is performed in which fuel is cut relative to the induction air amount $M_{A\text{-}MAN}$ when the throttle opening is zero, for example, and, following this, a flowed-in air amount MA that has been temperature corrected using the induction air temperature TA is calculated, then, the result of the calculation being multiplied by a reciprocal ratio of the target air-fuel ratio $AF_O$ and the result of the multiplication being further multiplied by the coolant temperature correction coefficient $K_W$ to calculate a required fuel inflow amount $M_F$. In contrast to this, the fuel adhesion ratio X is obtained from the engine rotational speed $N_E$ and the induction pipe internal pressure $P_{A\text{-}MAN}$ using a fuel adhesion ratio map, and the carry-away ratio $\tau$ is calculated from the engine rotational speed $N_E$ and the induction pipe internal pressure $P_{A\text{-}MAN}$ using a carry-away ratio map. Then, the residual fuel amount $M_{F\text{-}BUF}$ obtained during the previous operation is multiplied by the carry-away ratio $\tau$ to calculate a carried-away fuel mount $M_{F\text{-}\tau A}$, and what is so calculated is subtracted from the required fuel inflow amount $M_F$ to calculate the direct fuel inflow amount $M_{F\text{-}DIR}$. As has been described above, since this direct fuel inflow amount $M_{F\text{-}DIR}$ is (1−X) times larger than the fuel injection amount $M_{F\text{-}INJ}$, here, the direct fuel inflow amount MF-DIR is divided by (1−X) to calculate a steady-state fuel injection amount $M_{F\text{-}INJ}$. In addition, of the residual fuel amount MF-BUF that remained in the induction pipe until the previous time, since ($(1-\tau) \times M_{F\text{-}BUF}$) also remains this time, the fuel adhesion amount ($X \times M_{F\text{-}INJ}$) is added to this to represent a residual fuel amount $M_{F\text{-}BUF}$ for this time.

In addition, since the induction air amount calculated at the induction air amount calculating function unit 28 is such as to have been detected toward the end of the induction stroke or at the beginning of the compression stroke following the induction stroke of the previous cycle to an induction stroke which is about to shift to a power (expansion) stroke, a steady-state fuel injection amount and fuel injection timing that are calculated and set at this steady-state fuel injection amount calculating function unit 34 are also the results of the previous cycle which correspond to the induction air amount thereof.

In addition, the accelerating condition detecting function unit 41 has an accelerating condition threshold table. As will be described later on, this is a threshold for obtaining a difference value between the induction air pressure of the induction air pressure signal that results on the same stroke and at the same crank angle as those of the current induction air pressure and the current induction air pressure and then comparing the value so obtained with a predetermined value so as to detect the existence of an accelerating condition, and specifically speaking, the threshold differs each crank angle. Consequently, the detection of an accelerating condition is performed by comparing the difference value from the previous value of the induction air pressure with the predetermined value which differs each crank angle.

Figure 8:
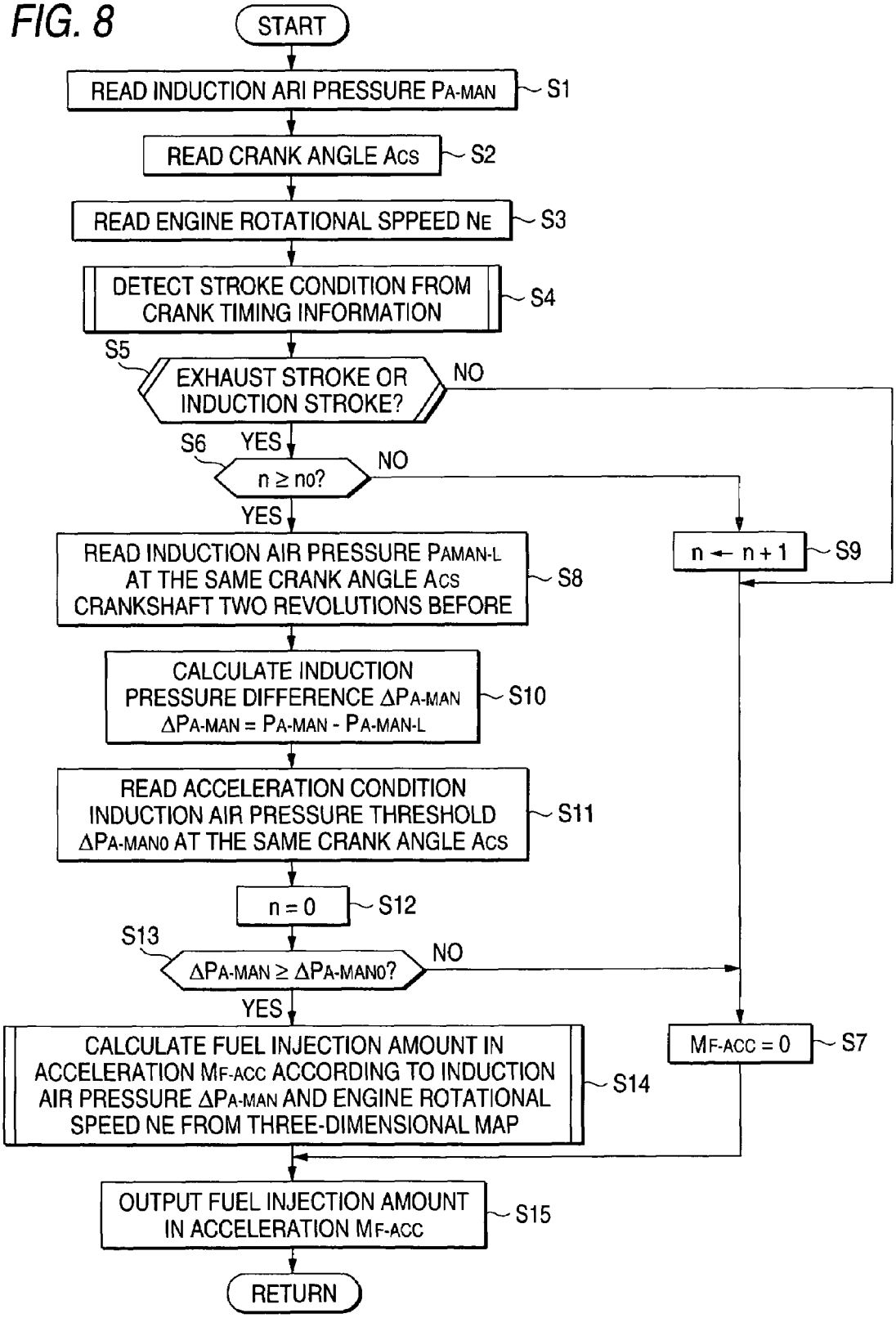
FIG. 8 is a flowchart illustrating a detection of an accelerating condition and a calculation of a fuel injection amount in acceleration.

The accelerating condition detecting function unit 41 and the fuel injection amount in acceleration calculating function unit 42 are made to function substantially together in an operation process shown in FIG. 8. This operation process is executed every time the crank pulse is inputted. Note that while no special step for communication is provided in this operation process, information obtained through the operation process is stored in a memory from time to time, and information required for the operation process is read in from the memory from time to time.

In this operation process, firstly, in step S1, an induction air pressure $P_{A\text{-}MAN}$ is read from the induction air pressure signal.

Next, the flow proceeds to step S2, where a crank angle $A_{CS}$ is read from the crank angle signal.

Next, the flow proceeds to step S3, where an engine rotational speed $N_E$ from the engine rotational speed calculating function unit 26 is read.

Next, the flow proceeds to step S4, where a stroke condition is detected from the crank timing information outputted from the crank timing detecting function unit 27.

Then, the flow proceeds to step S5, where whether or not the current stroke is an exhaust stroke or an induction stroke is determined, and if the current stroke is either an exhaust stroke or an induction stroke, the flow proceeds to step S6, whereas if the determination is made otherwise, then the flow proceeds to step S7.

In the step S6, whether or not a fuel injection in acceleration prohibition counter n is equal to or larger than a predetermined value no which permits a fuel injection in acceleration is determined, and if the fuel injection in acceleration prohibition counter n is equal to or larger than the predetermined value $n_0$, the flow proceeds to step S8, whereas if the determination is made otherwise, the flow proceeds to step S9.

In the step S8, the induction air pressure $P_{A\text{-}MAN\text{-}L}$ resulting two turns of the crankshaft before or resulting on the same stroke and at the same crank angle $A_{CS}$ of the previous cycle (hereinafter; also referred to as the previous value of the induction air pressure) is read, and thereafter, the flow proceeds to step S10.

In the step S10, the previous value of the induction air pressure $P_{A\text{-}MAN\text{-}L}$ is subtracted from the current induction air pressure $P_{A\text{-}MAN}$ so as to calculate an induction air pressure difference $\Delta P_{A\text{-}MAN}$, and thereafter, the flow proceeds to step S11.

In the step S11, an accelerating condition induction air pressure difference threshold $\Delta P_{A\text{-}MANO}$ of the same crank angle $A_{CS}$ is read from the accelerating condition threshold table and thereafter, the flow proceeds to step S12.

In the step S12, the fuel injection in acceleration prohibition counter n is cleared, and thereafter, the flow proceeds to step S13.

In the step S13, whether or not the induction air pressure $\Delta P_{A\text{-}MAN}$ calculated in the step S10 is equal to or larger than the accelerating condition induction air pressure difference threshold $\Delta P_{A\text{-}MANO}$ of the same crank angle $A_{CS}$ read in the step S11 is determined, and if the induction air pressure $\Delta P_{A\text{-}MAN}$ is equal to or larger than the accelerating condition induction air pressure difference threshold $\Delta P_{A\text{-}MANO}$, then the flow proceeds to step S14, whereas if the determination is made otherwise, the flow proceeds back to the step S7.

On the other hand, in the step S9, the fuel injection in acceleration prohibition counter n is incremented, and thereafter, the flow proceeds back to the step S7.

In the step s14, a fuel injection amount in acceleration $M_{F\text{-}ACC}$ according to the induction air pressure difference $\Delta P_{A\text{-}MAN}$ calculated in the step S10 and the engine rotational speed NE read in the step S3 is calculated from a three-dimensional map, and thereafter, the flow proceeds to step S15.

In addition, in the step S7, the fuel injection amount in acceleration $M_{F\text{-}ACC}$ is set to "0", and thereafter, the flow proceeds to the step S15.

In the step S15, the fuel injection amount in acceleration $M_{F\text{-}ACC}$ which was set in the step S14 or the step S7 is outputted and then, the flow returns to the main program.

In addition, in this embodiment, when the accelerating condition is detected at the accelerating condition detecting function unit 41, namely, when the induction air pressure $\Delta P_{A\text{-}MAN}$ calculated in the step S10 is determined to be equal to or larger than the accelerating condition induction air pressure difference threshold $\Delta P_{A\text{-}MANO}$ in the step S13 of the operation process shown in FIG. 8, the fuel injection timing in acceleration is immediately fuel injected. In other words, fuel in acceleration is injected when it is determined that the accelerating condition exists.

In addition, the ignition timing setting function unit 31 includes a basic ignition timing calculating function unit 36 for calculating a basic ignition timing based on the engine rotational speed calculated at the engine rotational speed calculating function unit 26 and the target air-fuel ratio calculated at the target air-fuel ratio calculating function unit 33 and an ignition timing correcting function unit 38 for correcting the basic ignition timing calculated at the basic ignition timing calculating function unit 36 based on the fuel injection amount in acceleration calculated at the fuel injection amount in acceleration calculating function unit 42.

The basic ignition timing calculating function unit 36 obtains trough map retrieving an ignition timing where a torque generated becomes maximum with the current engine rotational speed and the then target air-fuel ratio and calculate the ignition timing as a basic ignition timing. Namely, as in the case with the steady-state fuel injection amount calculating function unit 34, the basic ignition timing calculated at the basic ignition calculating function unit 36 is based on the result of the induction stroke on the previous cycle. In addition, the ignition timing correcting function unit 38 obtains in accordance with the fuel injection amount in acceleration calculated at the fuel injection amount in acceleration calculating function unit 42 a cylinder internal air-fuel ratio resulting when the fuel injection amount in acceleration was added to the steady-state fuel injection amount and sets a new ignition timing using the cylinder internal air-fuel ratio, the engine rotational speed and the induction air pressure when the cylinder internal air-fuel ratio largely differs from the target air-fuel ratio set at the steady-state target air-fuel ratio calculating function unit 33, whereby the ignition timing is corrected.

Next, the function of the operation process shown in FIG. 8 will be described following a timing chart shown in FIG. 9. In this timing chart, the throttle was constant until a time $t_{06}$, the throttle was opened linearly for a relatively short period of time from the time $t_{06}$ to a time $t_{15}$, and thereafter, the throttle became constant. In this embodiment, the inlet valve is set so as to be released from slightly before the top dead center on the exhaust stroke to slightly after the bottom dead center on the compression stroke. A curve illustrated as accompanying diamond-shaped plots in the diagram represents induction air pressure, and a pulse-like waveform illustrated at a bottom portion of the diagram represents fuel injection amount. As has been described before, a stroke where the induction air pressure decreases drastically is an induction stroke and a compression stroke, an expansion (a power) stroke and an exhaust stroke follow the induction stroke in that order to repeat cycles.

The diamond-shaped plots on the induction air pressure curve indicate crank pulses provided every 30 degrees, and target air-fuel ratios according to engine rotational speeds are set at circled crank angle positions (240 degrees) of the crank pulses so plotted, whereby the steady-state fuel injection amount and fuel injection timing are set using the induction air pressure detected then. In this timing chart, fuel in a steady-state fuel injection amount set at a time $t_{O2}$ is injected at a time $t_{03}$, and thereafter, in the similar manner, fuel in a steady-state fuel injection amount set at a time $t_{05}$ is injected at a time $t_{07}$, fuel in a steady-state fuel injection amount set at a time tog is injected at a time $t_{10}$, fuel in a steady-state fuel injection amount set at a time $t_{11}$ is injected at a time $t_{12}$, fuel in a steady-state fuel injection amount set at a time $t_{13}$ is injected at a time $t_{14}$, and fuel in a steady-state fuel injection amount set at a time $t_{17}$ is injected at a time $t_{18}$. While since the induction air pressure of the steady-state fuel injection amount set at the time tog and injected at the time $t_{10}$ of these induction air pressures, for example, has become larger than those of the fuel injection amounts therebefore and, as a result, a large induction air amount has been calculated, a large induction air amount is set, since the steady-state fuel injection amount is set, in general, on the compression stroke and the steady-state fuel injection timing is set, in general, on the exhaust stroke, it is not true that the then intention of the rider to accelerate is reflected to the steady-state fuel injection amount. Namely, although the throttle started to be opened at the time $t_{06}$, since the steady-state fuel injection amount that is injected thereafter at the time to $t_{07}$ was set at the time $t_{05}$ which is earlier than the time $t_{06}$, only fuel in a small amount was injected in contrast to the intension to accelerate.

Figure 9:
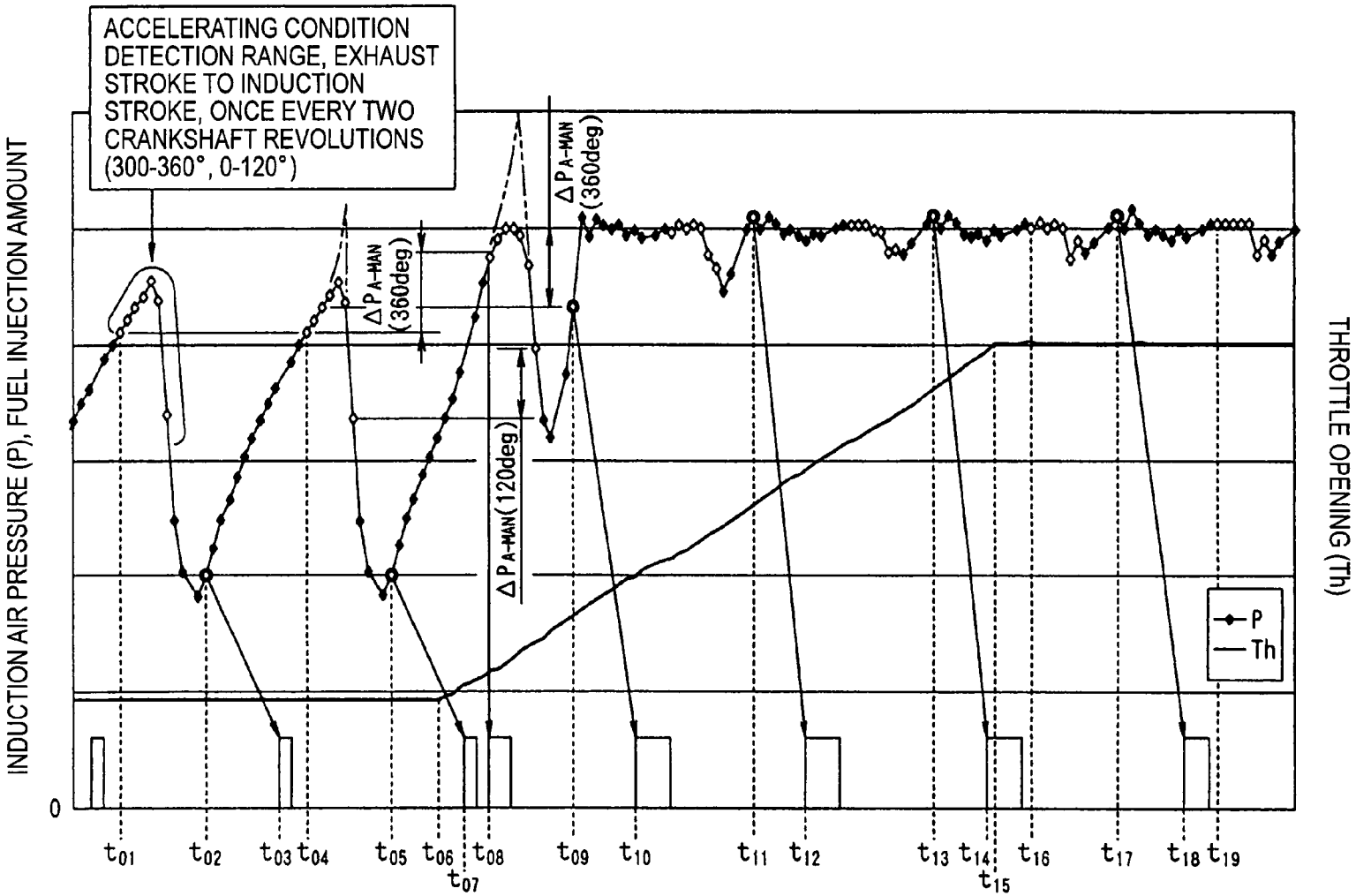
FIG. 9 is a timing chart illustrating the function of an operation process in FIG. 8.

On the other hand, in the embodiment, the induction air pressure $P_{A\text{-}MAN}$ at the same crank angle on the previous cycle is compared at the white diamond-shaped crank angles illustrated in FIG. 9 from the exhaust stroke to the induction stroke by the operation process shown in FIG. 8, and the resultant difference value is calculated as an induction air pressure difference $\Delta P_{A\text{-}MAN}$ for comparison with the threshold $\Delta P_{A\text{-}MAN0}$. For example, in the event that the induction air pressures $P_{A\text{-}MAN(300deg)}$ at the crank angle of 300 degrees at the time t01 and the time t04 or the time t16 and the time t19 are compared with each other, the induction air pressures are almost the same, and the difference value from the previous value, that is, the induction air pressure difference $\Delta P_{A\text{-}MAN}$ is small. However, the induction air pressure $P_{A\text{-}MAN(300deg)}$ at the crank angle of 300 degrees at the time to 8 when the throttle opening becomes large relative to the induction air pressure $P_{A\text{-}MAN(300deg)}$ at the crank angle of 300 degrees on the previous cycle or at the time $t_{04}$ when the throttle opening is small. Consequently, the induction air pressure difference $\Delta P_{A\text{-}MAN(300deg)}$ resulting when the induction air pressure $P_{A\text{-}MAN(300deg)}$ at the crank angle of 300 degrees at the time $t_{04}$ is subtracted from the induction air pressure $P_{A\text{-}MAN(300deg)}$ at the crank angle of 300 degrees at the time $t_{08}$ is compared with the threshold $\Delta P_{A\text{-}MAN0}$, and if the induction air pressure difference $\Delta P_{A\text{-}MAN\ (300deg)}$ is larger than the threshold $\Delta P_{A\text{-}MAN0}$, it can be detected that the accelerating condition is existing.

Incidentally, the accelerating condition detection by the induction air pressure difference $\Delta_{PA\text{-}MAN}$ is more remarkable on the induction stroke. For example, an induction air pressure difference $\Delta P_{A\text{-}MAN(120deg)}$ at the crank angle of 120 degrees on the induction stroke is easy to appear clearly. However, depending upon the characteristic of an engine, for example, as shown by double-dashed lines in FIG. 9, the induction air pressure curve becomes steep and indicates a so-called peaky characteristic, and there is caused a deviation between detected crank angle and induction air pressure. As a result, there is caused a risk that a deviation is caused in an induction air pressure difference that is calculated. Due to this, the detection range is extended as far as the exhaust-stroke where the induction air pressure curve becomes relatively moderate, so that an accelerating condition detection by the induction air pressure difference is performed on the both strokes. Of course, depending on the characteristic of the engine, the accelerating condition detection may be performed on either of the strokes only.

Note that with a four-cycle engine such as used in this embodiment, both the exhaust stroke and the induction stroke happen only once while the crankshaft turns twice. Consequently, with a motorcycle engine such as used in this embodiment which is provided with no camshaft sensor, even if the crank angle is simply detected, whether the current stroke is either of those stokes cannot be determined. Then, the stroke condition based on the crank timing information detected at the crank timing detecting function unit 27 is read, and after it is determined that the current stroke is either of those strokes, the accelerating condition detection by the induction air pressure difference $\Delta P_{A\text{-}MAN}$ is performed, whereby a more accurate accelerating condition detection is made possible.

In addition, as it is made clear from a comparison with the induction air pressure difference $\Delta P_{A\text{-}MAN(360deg)}$ at the crank angle of 360 degrees shown in FIG. 9, for example, although it cannot be made clear from a comparison between the induction air pressure difference $\Delta P_{A\text{-}MAN(300deg)}$ at the crank angle of 300 degrees and the induction air pressure difference $\Delta P_{A\text{-}MAN(120deg)}$ at the crank angle of 120 degrees, even with an equivalent throttle opening condition, the induction air pressure difference $\Delta P_{A\text{-}MAN}$ which is a difference value from the previous value differs at each crank angle. Consequently, the accelerating condition induction air pressure threshold $\Delta P_{A\text{-}MAN0}$ has to be changed at each crank angle $A_{CS}$. Then, in this embodiment, in order to detect an accelerating condition, the accelerating condition induction air pressure threshold $\Delta P_{A\text{-}MAN0}$ is tabulated at each crank angle $A_{CS}$ for storage, and the accelerating condition induction air pressure threshold $\Delta P_{A\text{-}MAN0}$ so tabulated for storage is read at each crank angle $A_{CS}$ for comparison with the induction air pressure difference $\Delta P_{A\text{-}MAN}$, whereby a more accurate accelerating condition detection is made possible.

Then, in this embodiment, the fuel injection amount in acceleration $M_{F\text{-}ACC}$ according to the engine rotational speed NE and the induction air pressure difference $\Delta P_{A\text{-}MAN}$ is injected immediately at the time $t_{08}$ when the accelerating condition is detected. Setting the fuel injection amount in acceleration $M_{F\text{-}ACC}$ according to the engine rotational speed $N_E$ is extremely common, and normally, the fuel injection amount is set smaller as the engine rotational speed increases. In addition, since the induction air pressure difference $\Delta P_{A\text{-}MAN}$ is equal to the variation in throttle opening, the fuel injection amount is set larger as the induction air pressure difference increases. Substantially, even if fuel in that fuel injection amount is injected, since the induction air pressure is already high and induction air in a larger amount is to be induced on the following induction stroke, there is no risk that a knock is caused due to the air-fuel ratio in the cylinder becoming too small. Then, in this embodiment, since fuel is designed to be injected immediately the accelerating condition is detected, the air-fuel ratio in the cylinder where the stroke is about to be shifted to the power stroke can be controlled to an air-fuel ratio suited to the accelerating condition, and an acceleration feeling that the rider attempts to have can be obtained by setting the fuel injection amount in acceleration according the engine rotational speed and the induction air pressure difference.

In addition, in this embodiment, since a fuel injection in acceleration is not performed even when the accelerating condition is detected until the fuel injection in acceleration prohibition counter n becomes equal to or larger than the predetermined value n0 which permits a fuel injection in acceleration after the accelerating condition has been detected and a fuel injection amount in acceleration has been injected from the injection device, the air-fuel ratio in the cylinder is prevented from being brought into an over-rich condition due to the repetition of the fuel injection in acceleration.

In addition, the necessity of an expensive and large-scale camshaft sensor can be obviated by detecting the stroke condition from the phase of the crankshaft.

Thus, in the embodiment where the accelerating condition or the engine load is detected from the induction air pressure, a smooth change in induction air pressure according to the stroke such as shown in FIG. 3, for example, is required. In addition, in the event that an induction air amount, which also means the engine load, is calculated from the induction air pressure as has been described before, a real change in induction air pressure according to the stroke is required to some extent.

Figure 10:
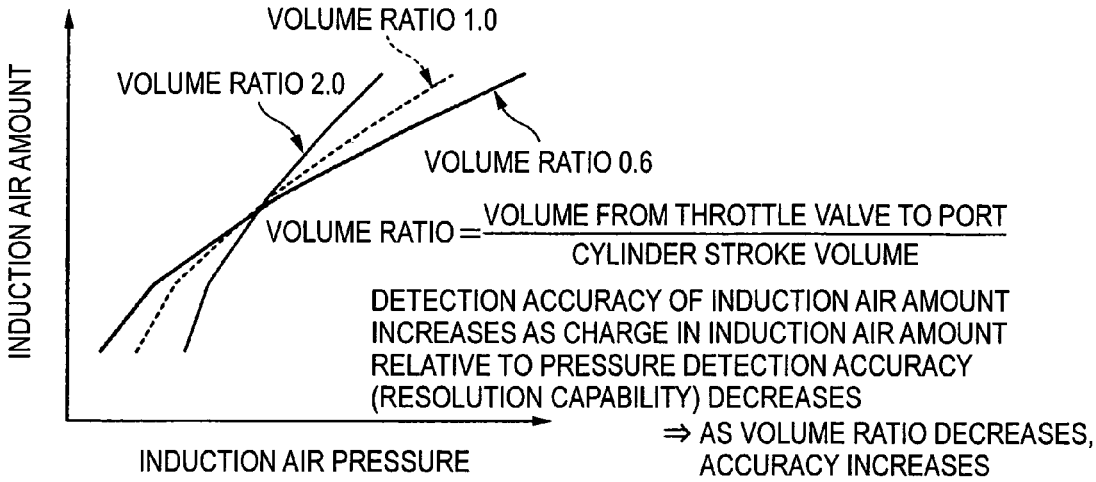
FIG. 10 is an explanatory diagram illustrating an induction air amount relative to an induction air pressure when a volume ratio between a cylinder stroke volume and a throttle downstream volume.

FIG. 10 illustrates the result of a measurement of a change in induction air amount relative to the induction air pressure by changing a ratio (hereinafter, also referred to as a volume ratio) between a volume from the throttle valve to the induction port (hereinafter, also referred to as a throttle downstream volume) and a cylinder stroke volume which is referred to in general as a displacement of each cylinder. As is clear from the diagram, the smaller the volume ratio becomes, the smaller the change in the induction air amount relative to the change in induction air pressure becomes. In other words, the smaller the volume becomes, the smaller the change rate of the induction air amount relative to the induction air pressure becomes. Since this means that the smaller the change in induction air amount relative to the detection accuracy or resolution capability of induction air pressure, the more the detection accuracy of induction air amount improves, the volume ratio of the throttle downstream volume relative to the cylinder stroke volume becomes better as it becomes smaller. This is because as the volume ratio of the throttle downstream volume relative to the cylinder stroke volume becomes larger, a space from the throttle valve to the induction port exhibits more a damper effect to thereby deteriorate the response to a change in induction air pressure on the induction stroke. A similar thing to this also applies to the detection of accelerating condition.

Substantially, in an area where the volume ratio of the throttle downstream volume relative to the cylinder stroke volume exceeds "1", the calculation of an induction air amount which is sufficient for controlling the operating condition of the engine from the induction air pressure is difficult. Then, in this embodiment, an induction air amount which is sufficient for controlling the operating condition of the engine can be calculated by setting the volume ratio of the throttle downstream volume relative to the cylinder stroke volume is set equal to or larger than "1", or setting the throttle downstream volume equal to or larger than the cylinder stroke volume. In addition, this allows for a more accurate detection of the accelerating condition.

Figure 11:
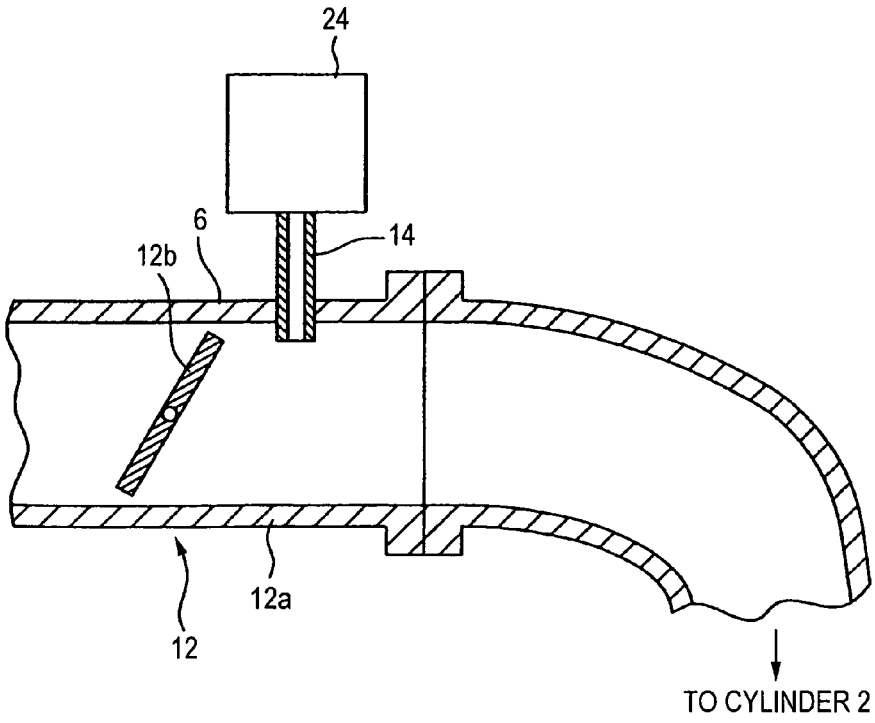
FIG. 11 is an explanatory diagram illustrating a throttle valve, a cylinder and an induction pipe pressure sensor.

In addition, as has been described above, on common motorcycles, the throttle valve 12 and the engine main body or the cylinder 2 are separate. As shown in FIG. 11, the throttle valve 12 includes a throttle body 12*a* and a valve main body 12*b*, and in order that the throttle valve 12 is not much subjected to the influence of vibrations of the engine main body, it is general practice to interpose a shock-absorbing material between the cylinder 2 and the throttle body 12*a*. The throttle valve 12 and the cylinder 2 are made to be formed into separate units from this constructional constraint, and the both units are coupled together using an individual coupling tool such as a bolt and a band. Then, in this embodiment, a pressure introducing pipe 14 is attached to the throttle body 12*a* on a throttle valve 12 side, and the induction pipe pressure sensor 24 is attached to a distal end of the pressure introducing pipe 14. This is because the induction pipe pressure sensor 24 is prevented from being brought into a direct contact with fuel.

Figure 12A:
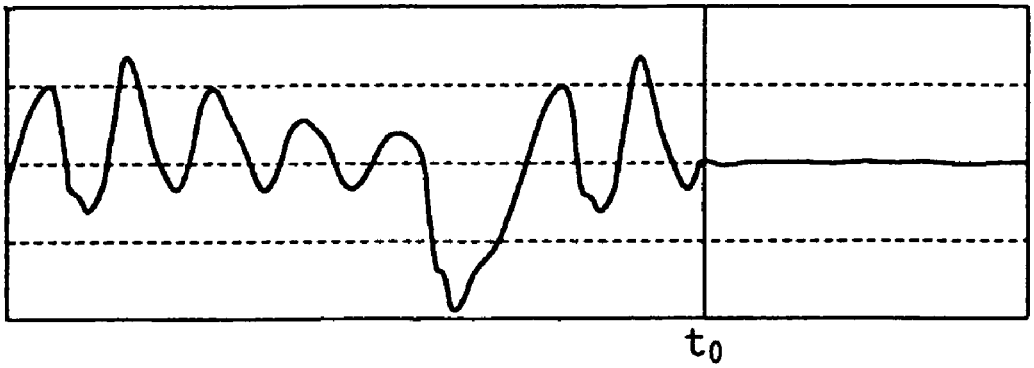
FIGS. 12*a* and 12*b* are explanatory diagrams illustrating induction pipe pressures which are detected by the induction pipe pressure sensor when the throttle valve is dislocated from the cylinder.

In this embodiment where no camshaft sensor is used as has been described before, the induction pipe pressure and the crank angle are substantially only control inputs. Consequently, should the throttle valve 12 be dislocated from the cylinder 2, a fail safe needs to performed from the malfunction in detecting the induction air pressure. FIG. 12*a* shows a detected induction pipe pressure when the throttle valve 12 is dislocated from the cylinder at the time $t_0$. When the throttle valve 12 is dislocated from the cylinder 2, since the induction pipe pressure sensor 24 is opened to the atmosphere only to detect the atmospheric pressure, the induction pipe pressure becomes constant at the atmospheric pressure after the time $t_0$. Consequently, when the induction pipe pressure so detected remains constant at the atmospheric pressure while the engine is determined to continue to rotate from the crank pulse, it is determined that the throttle valve is dislocated, and hence a suitable fail safe to such a dislocation can be provided.

Figure 12B:
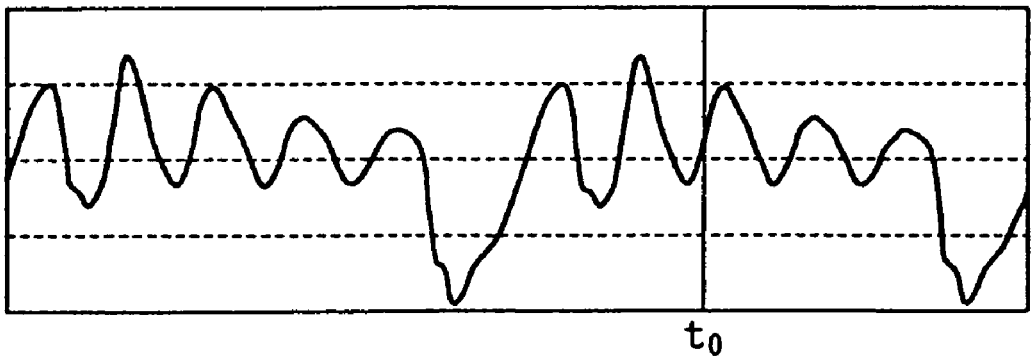

In contrast to this, FIG. 12*b* shows a detected induction pipe pressure when the throttle valve is dislocated at the time $t_0$ with the throttle valve being attached to the cylinder side. As is clear from the diagram, although the induction pipe on the cylinder side should also have been opened to the atmosphere due to the dislocation of the throttle valve, since a pulsation of the induction pipe pressure which is substantially similar to those which have happened before is detected, in the method that has been described above, the dislocation of the throttle valve cannot be detected, and hence an ensured fail safe cannot be performed.

Note that while the embodiment has been described as being applied to the induction pipe injection-type engine, the engine control system of the invention can similarly be applied to a direct injection-type engine. However, with the direct injection-type engine, since there is no case where fuel adheres to the induction pipe, there is no need to think over it, and in calculating an air-fuel ratio, only the total fuel injection amount that is injected may have to be substituted.

In addition, while the embodiment has been described as being applied to the single-cylinder engine, the engine control system of the invention may similarly be applied to a so-called a multi-cylinder engine which has two or more cylinders.

In addition, in the engine control units, various types of operation circuits can be used in place of the microcomputer.

INDUSTRIAL APPLICABILITY

As has been described heretofore, according to the engine control system of the invention, since the operating condition of the engine is controlled based on the load of the engine which is detected based on the detected crankshaft phase and induction air pressure, an accelerating condition is detected to be occurring when, for example, the difference value between the induction air pressure resulting in the same crankshaft phase on the same stroke of the previous cycle and the current induction air pressure is equal to or larger than the predetermined value. Then, when the accelerating condition is so detected, in the event that fuel is injected immediately, for example, a sufficient acceleration can be obtained which corresponds to the intention of the rider. In addition, since the volume from the throttle valve to the induction port is made equal to or smaller than the cylinder stroke volume, the detection of the load or detection of the accelerating condition by the calculation of the induction air amount and comparison between the induction air pressures can be made more accurate.

What is claimed is:

1. An engine control system comprising: phase detection means for detecting a phase of a crankshaft of a four-cycle engine, induction air pressure detection means for detecting an induction air pressure on a downstream side of a throttle valve within an induction passageway of the engine, and engine control means for detecting a load of the engine based on the phase of the crankshaft detected by the phase detection means and the induction air pressure detected by the induction air pressure detection means and controlling operating conditions of the engine based on the load of the engine so detected, wherein a volume from the throttle valve to an induction port of the engine is made equal to or smaller than the volume of the stroke of a cylinder, and the induction air pressure detection means is attached to a throttle body separately formed from the cylinder.

* * * * *